US006343128B1

(12) United States Patent
Coffin

(10) Patent No.: US 6,343,128 B1
(45) Date of Patent: Jan. 29, 2002

(54) DUAL CONE LOUDSPEAKER

(76) Inventor: C. Ronald Coffin, 18 John's La., Topsfield, MA (US) 01983

( * ) Notice: Subject to any disclaimer, the term of this patent is extended or adjusted under 35 U.S.C. 154(b) by 0 days.

(21) Appl. No.: 09/251,815

(22) Filed: Feb. 17, 1999

(51) Int. Cl.[7] ..... H04R 25/00
(52) U.S. Cl. ..... 381/186; 181/163
(58) Field of Search ..... 381/396, 184, 381/185, 186, 405, 182, 407, 424; 181/163, 144, 165

(56) References Cited

U.S. PATENT DOCUMENTS

| | | | | | |
|---|---|---|---|---|---|
| 1,545,718 | A | * | 7/1925 | Williams | |
| 1,667,251 | A | * | 4/1928 | Fay et al. | |
| 1,674,895 | A | * | 6/1928 | Fay et al. | |
| 1,815,987 | A | * | 7/1931 | Peterson | |
| 1,876,831 | A | * | 9/1932 | Ballantine | |
| 1,932,459 | A | * | 10/1933 | Harris | |
| 2,278,598 | A | * | 4/1942 | Turney | |
| 2,295,527 | A | * | 9/1942 | Bowley | |
| 2,553,539 | A | * | 5/1951 | Bauer | |
| 3,116,377 | A | * | 12/1963 | Todt | |
| 3,350,514 | A | * | 10/1967 | Cooke | |
| 3,573,396 | A | | 4/1971 | Schoengold | 179/115.5 R |
| 3,772,466 | A | | 11/1973 | Hossbach | 179/116 |
| 4,134,471 | A | | 1/1979 | Queen | 181/147 |
| 4,146,756 | A | * | 3/1979 | Kito et al. | |
| 4,301,332 | A | * | 11/1981 | Dusanek | |
| 4,477,699 | A | | 10/1984 | Wada et al. | 179/116 |
| 4,497,981 | A | | 2/1985 | House | 179/115.5 |
| 4,590,332 | A | * | 5/1986 | Delbuck | |
| 4,595,801 | A | * | 6/1986 | Coffin | |
| 4,613,316 | A | | 9/1986 | Reynolds | 464/85 |
| 4,821,330 | A | | 4/1989 | Pfleiderer | 381/184 |
| 4,845,776 | A | | 7/1989 | Bittencourt | 381/190 |
| 4,965,839 | A | | 10/1990 | Elieli | 381/195 |
| 4,996,713 | A | * | 2/1991 | Bittencourt | |
| 5,177,329 | A | | 1/1993 | Klayman | 181/156 |
| 5,295,194 | A | * | 3/1994 | Christensen | |
| 5,418,860 | A | * | 5/1995 | Daniels | |
| 5,548,657 | A | | 8/1996 | Fincham | 381/182 |
| 5,550,332 | A | | 8/1996 | Sakamoto | 181/148 |
| 5,621,804 | A | | 4/1997 | Beppu | 381/90 |
| 5,714,722 | A | | 2/1998 | Noponen | 181/173 |
| 5,822,444 | A | * | 10/1998 | Oizumi et al. | |

FOREIGN PATENT DOCUMENTS

| | | |
|---|---|---|
| GB | 2315314 | 1/1998 |
| JP | 62265896 | 5/1986 |

* cited by examiner

*Primary Examiner*—Sinh Tran
*Assistant Examiner*—Phylesha Dabney
(74) *Attorney, Agent, or Firm*—George A. Herbster

(57) ABSTRACT

A dual-cone loudspeaker includes a primary speaker cone and an axially displaced secondary speaker cone mounted to the back of a magnet structure. A rigid link causes both cones to move in unison. The rigid link includes an open support structure with equiangularly extending spokes that form a central hub. A ring circumscribes the spokes and ataches to the first speaker cone. A rigid element connects to the spokes and the secondary speaker cone so the primary and secondary speaker cones move in unison and improve the bass response for the loudspeaker. The rigid coupling device is also adapted to support a high frequency radiator to extend the overall loudspeaker frequency response into higher frequencies.

33 Claims, 8 Drawing Sheets

DUAL CONE LOUDSPEAKER

BACKGROUND OF THE INVENTION

1. Field of the Invention

This invention generally relates to acoustical loudspeakers and more particularly to acoustical loudspeakers with improved bass response.

2. Description of Related Art

My U.S. Pat. No. 4,595,801 discloses a dual cone loudspeaker with a primary speaker cone similar in function to a conventional dynamic loudspeaker mounted on a frame with a magnet structure. A secondary speaker cone mounts to a subframe on the back of the magnet structure and connects to the primary speaker cone through a rigid coupling device so the primary and secondary speaker cones move in unison. Sound waves from the secondary speaker cone travel through an orifice in a center pole piece of the magnet structure and through a hole in the center of the primary speaker cone radiating in the same direction as sound waves from the primary speaker cone. Consequently for a given excursion of the primary speaker cone my dual cone structure generates a sound having a greater sound volume than the primary cone alone by virtue of the simultaneous excursions of both the primary and secondary speaker cones that move a greater air volume for a given speaker cone displacement.

More specifically, the speaker disclosed in my patent includes a primary speaker cone with a frustoconical form with the center removed that attaches to a bobbin that carries a voice coil. The rigid coupling device includes a center link with radial spokes. The radially outer end of each spoke attaches directly to the secondary speaker cone at the voice coil bobbin. However, it is difficult to attach these outer ends of the radial spokes to the speaker cone or bobbin without distorting the voice coil. Moreover, adhesive or other techniques for bonding the ends of the radial spokes to the bobbin are subject to fatigue and ultimate failure. Stress concentrations at attachment points tend to force the bobbin out of round in operation contributing to a short life span for the speaker. It has also been found that this speaker is limited to operation at lower frequencies as a bass speaker. It would be helpful if the useful frequency range could be is extended to higher frequencies.

SUMMARY

Therefore it is an object of this invention to provide a dual cone loudspeaker with an improved linkage between the primary and secondary speaker cones.

Another object of this invention is to provide a coupled dual cone loudspeaker with a reliable construction.

Still another object of this invention is to provide improved linkage that enables a coupled dual cone loudspeaker to operate over an extended frequency range.

Yet another object of this invention is to provide a coupled dual cone loudspeaker that is easy to manufacture.

Yet still another object of this invention is to provide a coupled dual cone loudspeaker that is capable of broadcasting a wider range of frequencies with fidelity.

Still yet another object of this invention is to provide a coupled dual cone loudspeaker that can radiate a wide range of frequencies applied to a single voice coil.

Yet still another object of this invention is to provide a coupled dual cone loudspeaker capable of producing high frequency radiation independently of signals applied to a voice coil for a primary speaker cone.

In accordance with one aspect of this invention a coupled dual cone loudspeaker includes a first speaker cone resiliently suspended from a frame. A voice coil responds to first signals for displacing the first speaker cone relative to the frame. A second speaker cone is resiliently suspended from the frame and spaced from the first speaker cone. A ring attaches to the first speaker cone and an open support structure connects the ring to the second speaker cone whereby motion of the first speaker cone produces corresponding motion of the second speaker cone.

In accordance with another aspect of this invention, a dual-cone loudspeaker includes a loudspeaker frame, a first speaker cone resiliently suspended from the frame, voice coil for displacing the first speaker cone and a second speaker cone resiliently suspended from the frame and spaced from the first speaker cone. A link interconnects the first and second speaker cones whereby motion of the first speaker cone produce.,5 a corresponding motion of the second speaker cone. The loudspeaker additionally includes a high-frequency radiating structure attached to the link for producing high-frequency output signals in response to high-frequency signals applied to the voice coil.

In accordance with still another aspect of this invention, a dual-cone loudspeaker comprises a loudspeaker frame with a permanent magnet for defining a magnetic gap, a first speaker cone resiliently suspended from the frame, a second speaker cone resiliently suspended from the frame and spaced from the first speaker cone and a voice coil for being energized by an audio signal in electrical form. A cylindrical structure located in the magnetic field gap carries the voice coil and attaches to the first speaker cone whereby low frequency signals applied to the voice coil produce corresponding motion of the cylindrical structure. An open support structure formed centrally of the cylindrical structure includes a rigid link that connects to the second speaker cone whereby low frequency motion of the first speaker cone produces a corresponding motion of the second speaker cone.

In accordance with still another aspect of this invention, a dual-cone loudspeaker includes a loudspeaker frame with a permanent magnet means for defining a magnetic gap, a first speaker cone resiliently suspended from the frame and a second annular speaker cone resiliently suspended from said frame and spaced from said first speaker cone. A voice coil, energized by an audio signal in electrical form, is formed on a rigid cylindrical structure located in the magnetic field gap. The cylindrical structure is a component of a rigid link that interconnects the first and second speaker cones and that includes a rigid circular structure positioned in the opening through the second speaker structure and resiliently attached thereto about the periphery of the rigid circular structure and that includes a rigid element interconnecting the rigid cylindrical structure and the rigid circular structure. Low frequency signals applied to the voice coil produce corresponding motion of the first and second speaker cones and high frequency signals applied to the voice coil produce corresponding motion of the rigid circular structure.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENTS

Figure 1:
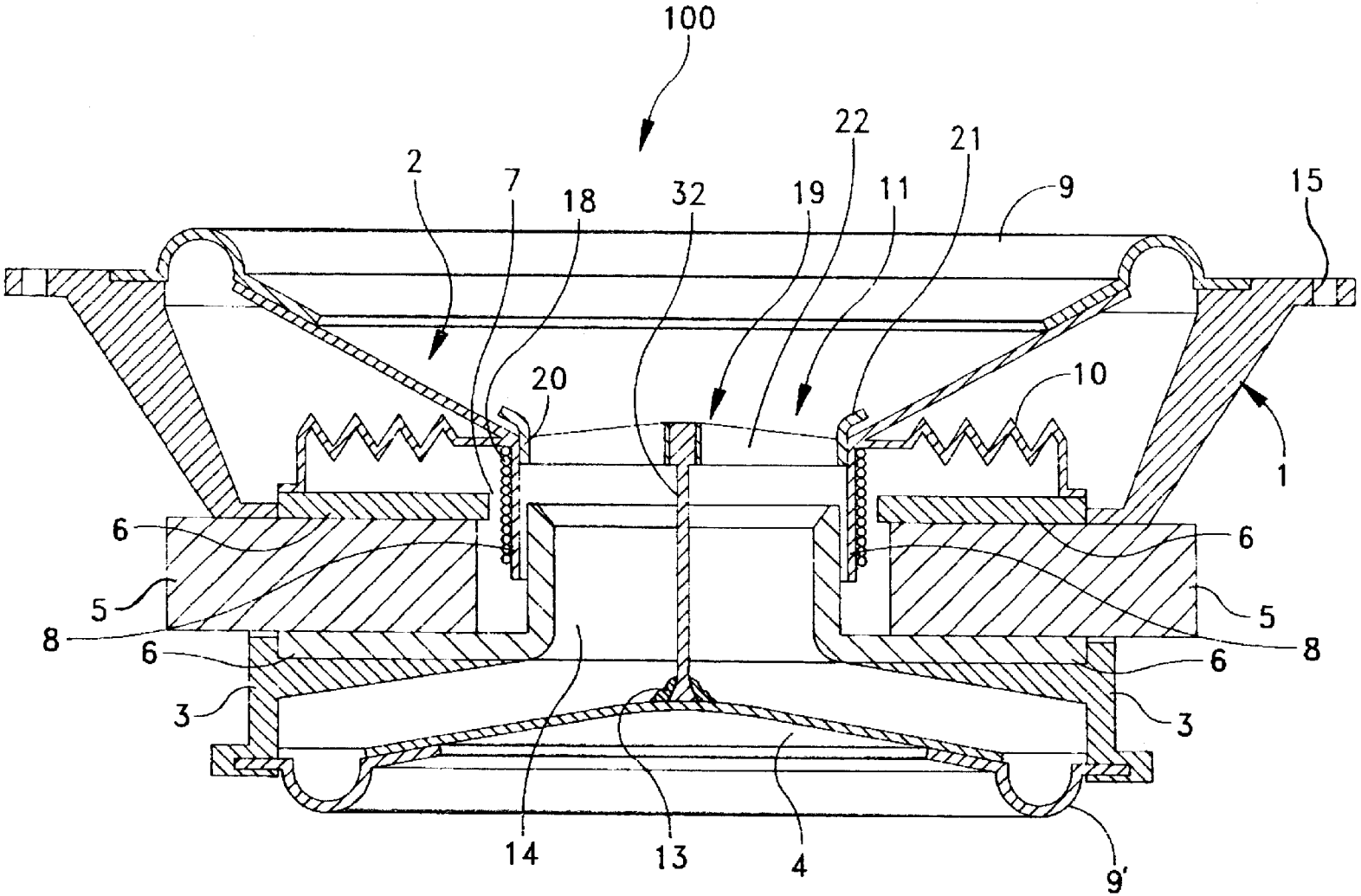
FIG. 1 is a view in cross-section of a dual cone loudspeaker constructed in accordance with this invention.
Figure 4:
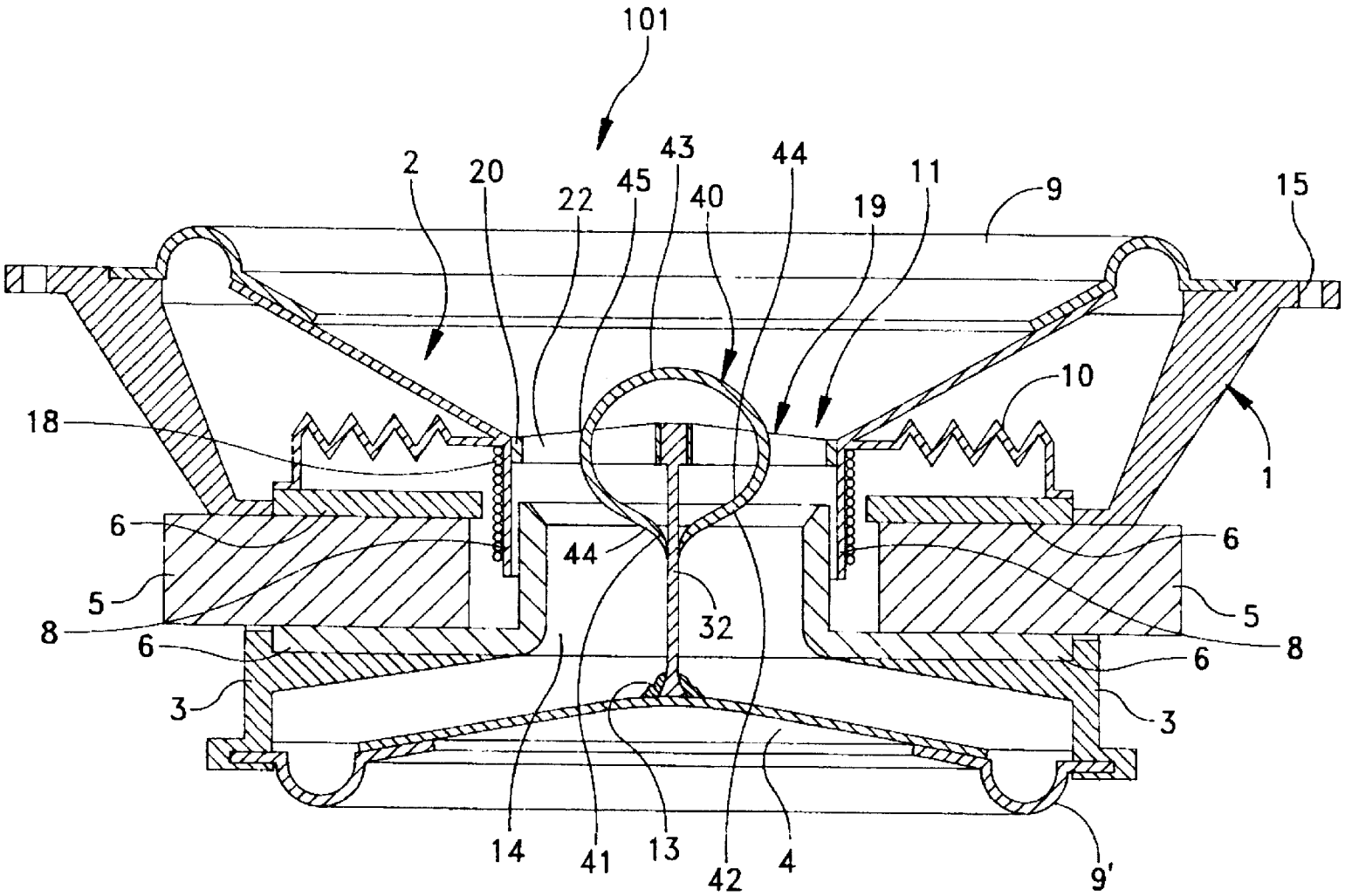
FIG. 4 depicts another embodiment of a dual cone loudspeaker constructed in accordance with this invention.
Figure 5:
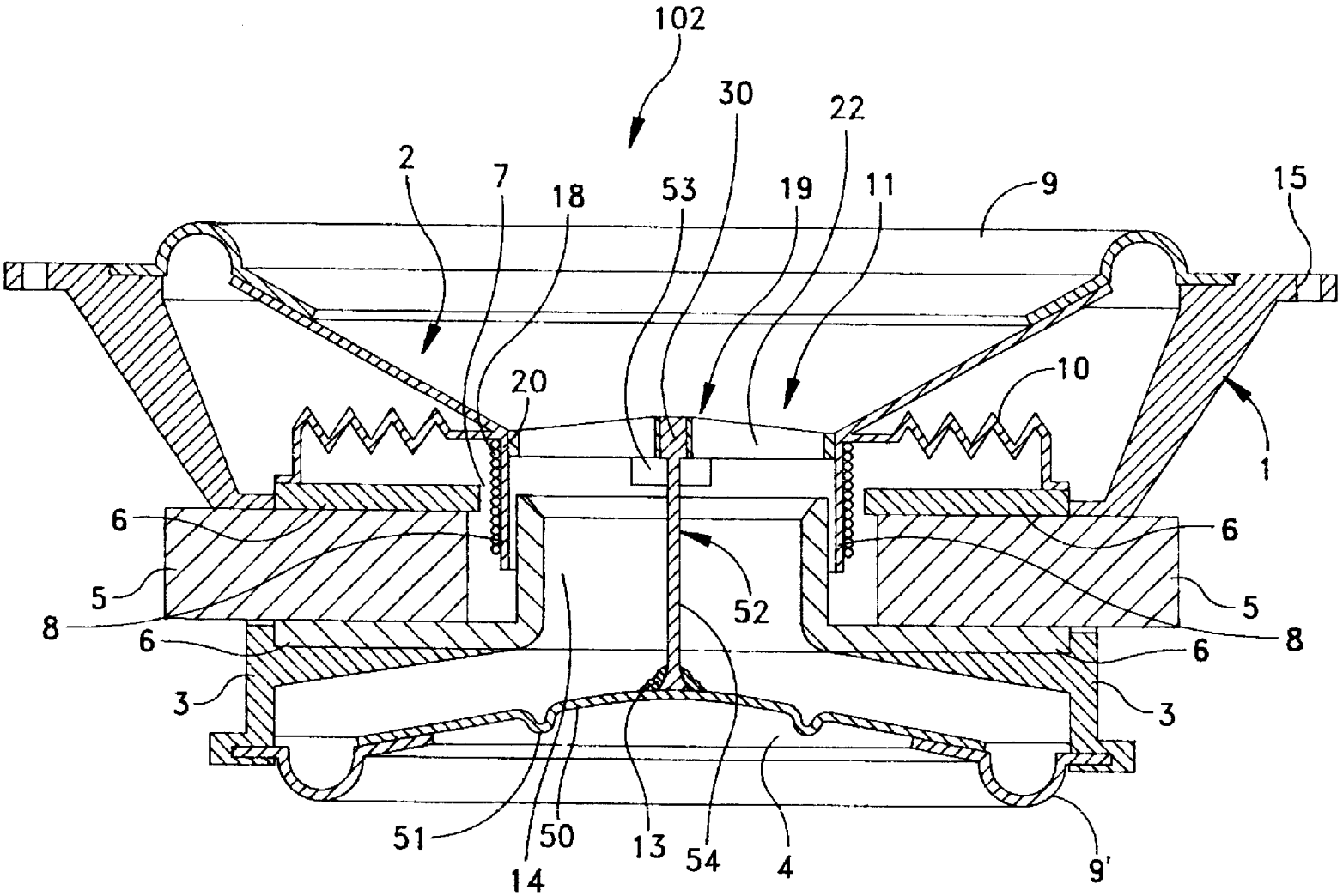
FIG. 5 depicts yet another embodiment of a dual cone loudspeaker constructed in accordance with this invention.

In this description FIGS. 1, 4 and 5 depict certain components that are common to each of these embodiments and to the coupled dual cone velocity driver speaker disclosed in my U.S. Pat. No. 4,595,801. Consequently, FIGS. 1, 4 and 7 use the same reference numerals to designate such components.

More specifically, a dual cone loudspeaker 100 shown in FIG. 1 and constructed in accordance with one aspect of this invention includes a rigid frame 1 to which a first speaker cone in the form of a primary speaker cone 2 is attached and a subframe 3 to which a second speaker cone in the form of a secondary speaker cone 4 is attached. Both frames 1 and 3 are mounted with a permanent magnet 5 to which pole pieces 6 are attached to form a magnetic field gap 7 into which a voice coil bobbin 8 with a voice coil 18 is placed. The voice coil bobbin 8 attaches to the base of the primary speaker cone 2 that is resiliently suspended from the frame 1 by a flexible surround 9 at its outer periphery and by a spider 10 at its bottom. A rigid link 11 that is constructed in accordance with one aspect of this invention and described more fully with respect to FIGS. 2 and 3, mechanically connects the voice coil structure 8 to the secondary speaker cone 4 by a center attachment 13 that may comprise a separate fastener or an adhesive material that bonds the link 11 to the secondary speaker cone 4.

The secondary speaker cone 4 attaches to the subframe 3 through a flexible surround 9'. The secondary speaker cone 4 forms a second air piston that is pneumatically coupled to the primary speaker cone 2 through an orifice or aperture 14 through a center one of the pole pieces 6. The aperture 14 is common to the closed chamber formed by the secondary speaker cone 4 and subframe 3 and the open chamber formed by the primary speaker cone 2. The frame 1 may, in accordance with conventional construction, contain a plurality of mounting holes 15 therethrough.

As described in the foregoing patent, when a signal energizes the voice coil 18, the interaction of the current in the voice coil 18 and the magnetic field in the magnetic field gap 7 causes the primary speaker cone 2 to displace in an alternating fashion at the frequency of the applied signal. As the rigid link 11 connects to both the primary speaker cone 2 and the secondary speaker cone 4, the air in the closed chamber in the secondary speaker cone 4 pumps into and out of the open chamber of the primary speaker cone 2 through the orifice 14. As a consequence a larger volume air flows than if there were only one primary speaker cone. The larger volume of air displaced results in a louder sound for a given cone excursion. However, the loudspeaker 100 occupies a cross-sectional area no bigger than a loudspeaker that has only a primary speaker cone.

Figure 2:
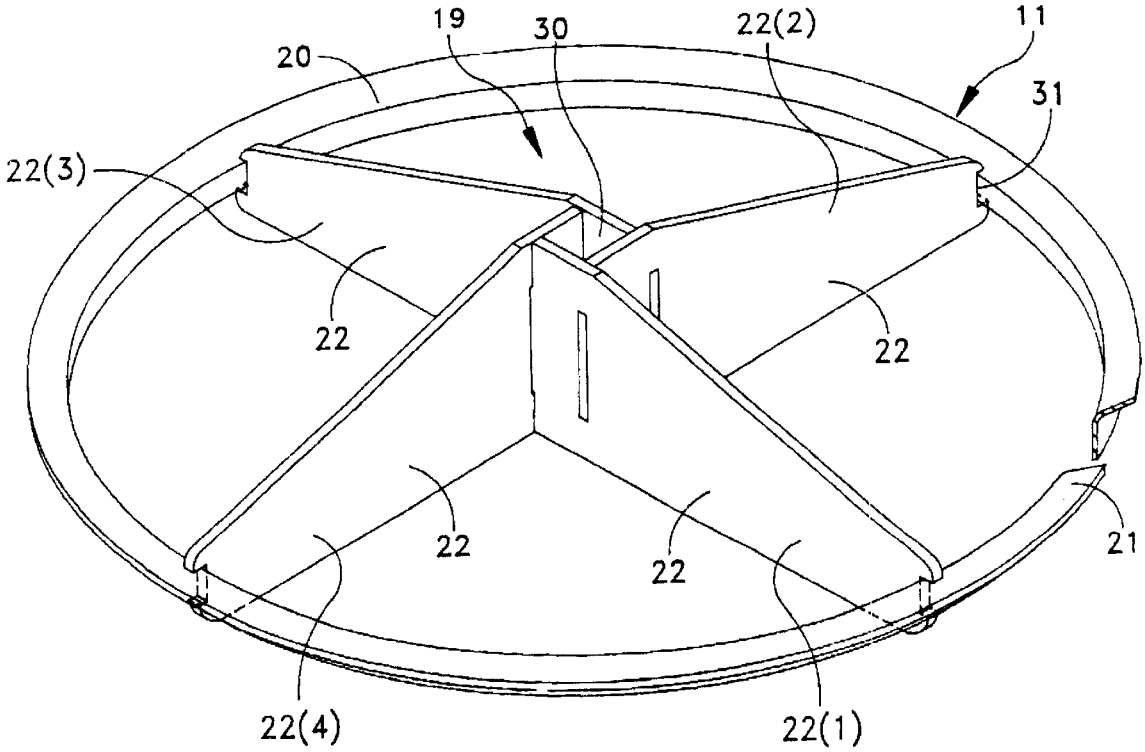
FIG. 2 is a perspective view of an open support structure constructed in accordance with this invention.
Figure 3:
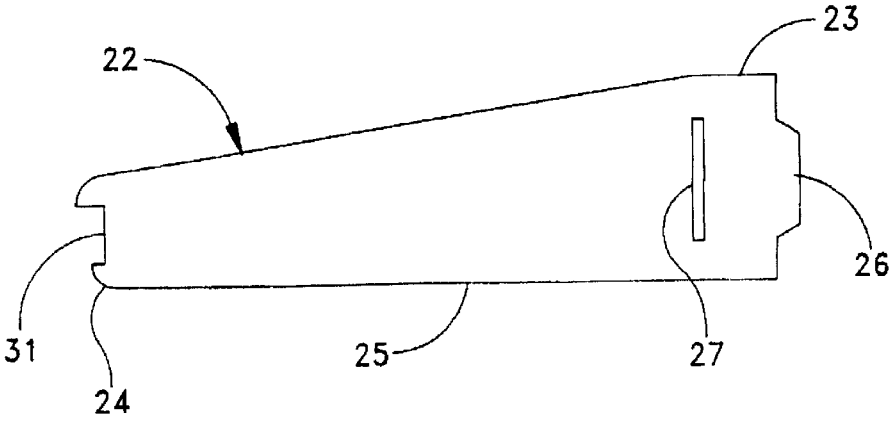
FIG. 3 depicts the detail of a single spoke in the open support structure of FIG. 2.

FIG. 2 depicts the rigid coupling device or link 11 that constitutes one aspect of this invention in more detail as including an open support structure 19 and a thin ring 20, that attaches by an adhesive or other method to the voice coil bobbin 8 that, in this embodiment provides increased rigidity to the ring 20. For a given strength or rigidity the flared end portion 21 enables the construction of a very light weight ring 20. The ring 20 also has a flared end portion 21. The increased surface area between the ring 20 and voice coil bobbin 8 assures a more reliable attachment between the rigid link 11 and the bobbin 8. Moreover, the open support structure 19 prevents the bobbin 21 from going out of round, especially when the ring 20 includes the flared end portion 21.

Referring again to FIG. 2, the open support structure 19 in the embodiment that attaches to the ring 20 includes a plurality of equiangularly spaced spokes 22. As shown more clearly in FIG. 3 each spoke 22 has a first end portion 23, a second end portion 24 and an intermediate body portion 25. A tab 26 extends from the first end portion 23 about a distance equal to the thickness of a spoke 22. A slot 27 extends through the first end portion for receiving a tab. The tab 26 from one spoke 22, such as a spoke designated as 22(1) in FIG. 2, engages the slot 27 in an adjacent spoke, designated 22(4) in FIG. 2. When all four spokes are assembled in this fashion, they form a hub 30 as shown in FIG. 2 that has a square aperture extending through the open support frame 12.

The second end 24 of each spoke 22 terminates in a radially outward facing transverse notch or channel 31 that enables the spoke 22 to engage the ring 20. Alternatively the ring might be found with slots and the spokes terminated with corresponding tabs. To conserve weight, the spokes 22 have a maximum dimension at the hub 30 where maximum strength is needed and a minimum dimension at the second end 24. The spokes 22 and the ring 20 form a rigid circular structure and, as previously indicated, prevent distortion of the bobbin 21 shown in FIG. 1.

Referring again to FIG. 1, in this embodiment the open support structure 19 additionally carries a rigid rod-like member 32 that extends from the hub 30 to the attachment 13. The combination of the ring 20 and open support structure 19 including the rigid member 32 provide a rigid link between the primary speaker cone 2 and the secondary speaker cone 4 that is more reliable than found in the prior art.

The open support structure 19 including any or all of ring 20, the spokes 22 and the link 31 can be made of metal or plastic so long as the structure remains rigid axially and lightweight. What is important is that the rigid link 11 including the ring 20, optimal flared end portion 21 and the open support structure 19 provides sufficient rigidity so that the second speaker cone 4 replicates any displacement of the first speaker cone 2.

FIG. 4 depicts another embodiment of a loudspeaker 101 constructed in accordance with this invention to enhance its frequency response. This embodiment utilizes the same rigid link 11 as described with respect to FIGS. 1, 2 and 3. I have found however, that notwithstanding the low frequency characteristic of the speaker shown in my patent, the bobbin 8 and voice coil 18 tend to vibrate at the composite driving frequency of the applied signal. This composite signal will have frequency components ranging from the low-bass to the high-treble regions of the audio spectrum. However, the mass of the primary speaker cone 2 and the secondary speaker cone 4 rapidly damp out any higher frequency components so that the primary speaker cone 2 and secondary speaker cone 4 do not radiate any significant energy at the higher frequencies. Consequently, the basic speaker in FIG. 1 is characterized by having a high frequency roll off. While in many applications this roll off is desirable, there are other applications in which the loudspeaker of FIG. 1 could benefit if it could operate with a frequency range extended into the mid-range and treble frequency ranges.

The increased strength and rigidity of the link 11 shown in FIG. 1 allows a further advantage of enabling the introduction of a high frequency radiating structure or radiator to enhance the frequency response of the loudspeaker, such as the loudspeaker 101 in FIG. 4. More specifically, a high frequency radiator 40 is positioned proximate the spokes 22 of the open support structure 12. The radiator 40 is rigid and spherical in shape. In one embodiment, a neck 41 attaches to the rigid member 32. An adjacent portion 42 of the radiator 40 is sectored to form gaps that allow this portion of the radiator to pass over the spokes 22. A surface portion 43 of the radiator 40 would be continuous and rigid to form a forward directed radiating surface housing having a semi-spherical shape.

The neck 41 and portion 42 flare from a narrow dimension at a lower end 44 facing the secondary speaker cone 4 to a maximum diameter at a position 45 adjacent the open web structure 19 of the primary speaker cone 2. The curved surface of the portion 42 smoothly directs any air flow to a location outside the high frequency radiator 40 thereby to minimize any turbulence that the high frequency radiator might otherwise introduce into the low frequency sound emanating from the secondary speaker cone 4. In another approach, the ring 20, spokes 22, radiator 40 and link 32 could be found as a molded structure with the central portion of the open structure 19 internally of the radiator being eliminated and the portions of the spokes 22 externally of the radiator 40 being formed as extensions of the radiator 40.

FIG. 5 depicts another embodiment 102 of a loudspeaker with an improved bass response modified to provide an enhanced high frequency response. In this embodiment the center portion of the secondary speaker cone 4 is replaced with a stiff high frequency radiator 50 attached to the annular speaker cone 4 by a surround 51. An attachment 13 as described in the other embodiments connects the high frequency radiator 50 to a rigid coupling device 52 carried by the open support structure 19. This rigid coupling device 52 includes a piezoelectric transducer 53 attached to the spokes 22 and hub and energized by a separate source (not shown). A rigid member 54 attaches to the output of piezoelectric transducer 53 and the attachment 13.

At low frequencies, the rigid coupling device 52 moves the primary speaker cone 2 in the same manner as occurs in the embodiments of FIGS. 1 and 4. The piezoelectric transducer 53 only receives high frequency signals from a crossover, phase or other adjustment network. As the transducer 53 receives only high frequency signals, at low frequencies the piezoelectric transducer 53, the member 54, the attachment 13 and the high frequency radiator 50 act as a rigid structure so that low frequency excursions of the voice coil 18 and bobbin 21 produce like excursions of the secondary speaker cone 4. Consequently, at low frequencies the composite of the speaker cone 4 and radiator 50 still act as a low frequency driver.

When higher frequencies energize the transducer 53, the transducer 53 drives the member 54 relative to the open support structure 12 and thereby displaces the high frequency radiator 50 at that same higher frequency. The surround 51 is constructed to enable this high frequency reciprocating motion of the high frequency radiator 50 to occur without impacting the motion of the secondary speaker cone 4.

In certain applications the signal applied to the high frequency radiator 50 may produce a signal that is out of phase with the signal from the primary cone 2 due to the distance between the primary speaker cone 2 and the high frequency radiator 50. The transducer 53 provides a tool for allowing a phase adjustment to compensate any such phase error.

Thus the loudspeaker 102 in FIG. 5 provides the advantages of improved bass response provided by the structure in FIG. 1 and, in addition, provides an enhanced frequency response by enabling the same basic structure to produce high frequency output. Depending on the nature of the physical size of the piezoelectric transducer 53, it may be desirable to include a streamlining structure in the embodiment of FIG. 5 comparable to the streamlining structure 41 shown in FIG. 4.

Figure 6:
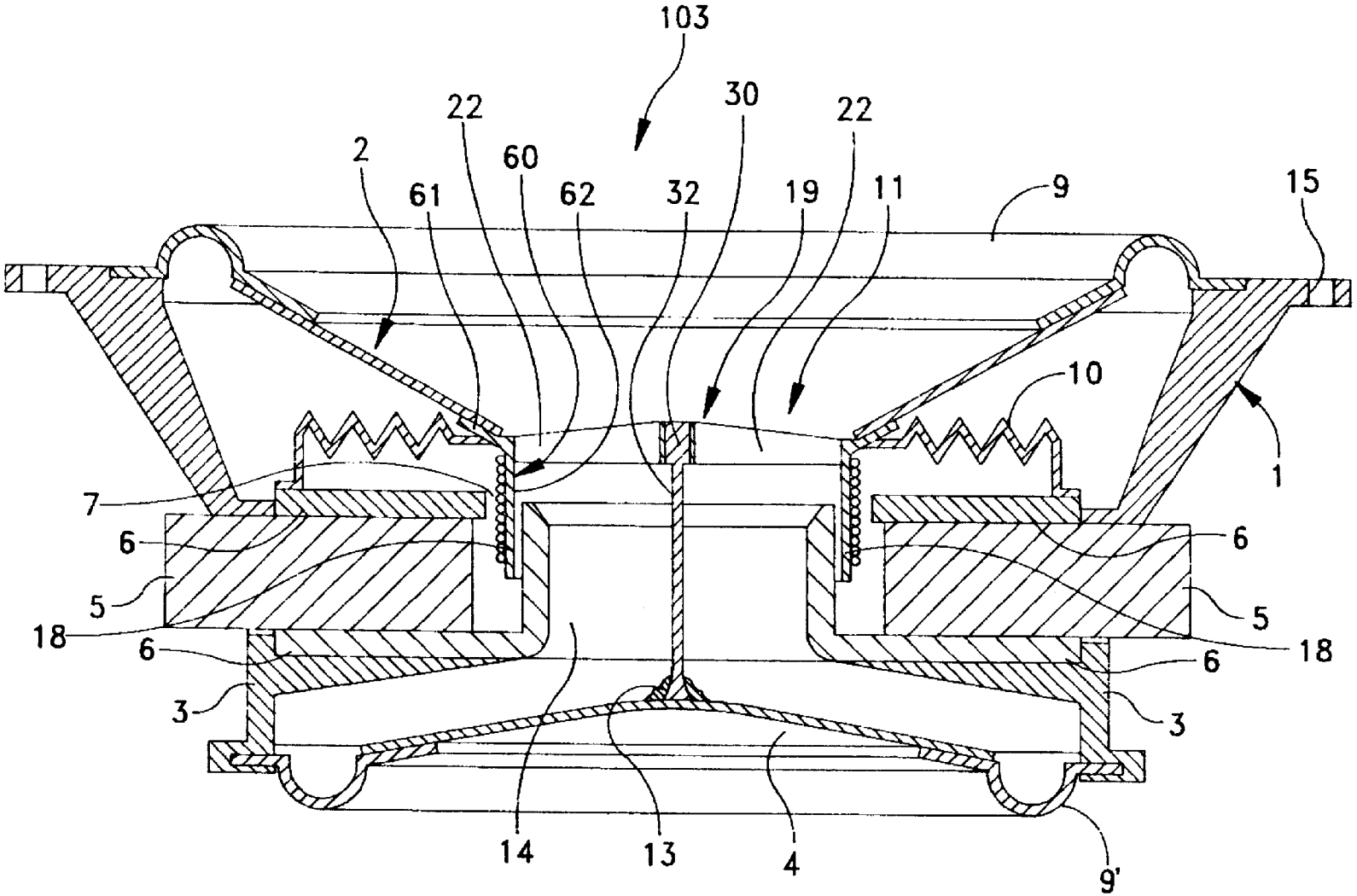
FIG. 6 details an alternative embodiment of an open support structure as shown in FIG. 2.

FIG. 6 depicts still another loudspeaker 103 in which the ring 20 shown in FIGS. 1, 4 and 5 is modified to provide a cylindrical structure that includes an integral elongated cylinder 60. This cylinder 60 performs both the stiffening and attachment functions of the ring 20 with respect to the spokes 22 and serves as a bobbin for the voice coil 10. The upper end of the cylinder 60 terminates in a conical upper end portion 61 that flares outwardly from the bobbin portion 62 like the flared end 21 in FIGS. 1 and 2. In addition to improving the strength of the ring portion, the flared portion 61 provides a surface for attachment of the primary speaker cone 2 and the spider 10 to produce a structure with even greater reliability than as shown in FIGS. 1, 4 and 5. Moreover, if the cylinder 60 is constructed of a lightweight metal or rigid plastic material, the overall weight of the cylinder 60 can be reduced thereby lowering the inertia of this structure to enhance frequency response further. Eliminating the ring-to-bobbin attachment minimizes a potential failure point. It has also been found that this structure is easy to manufacture.

Figure 7:
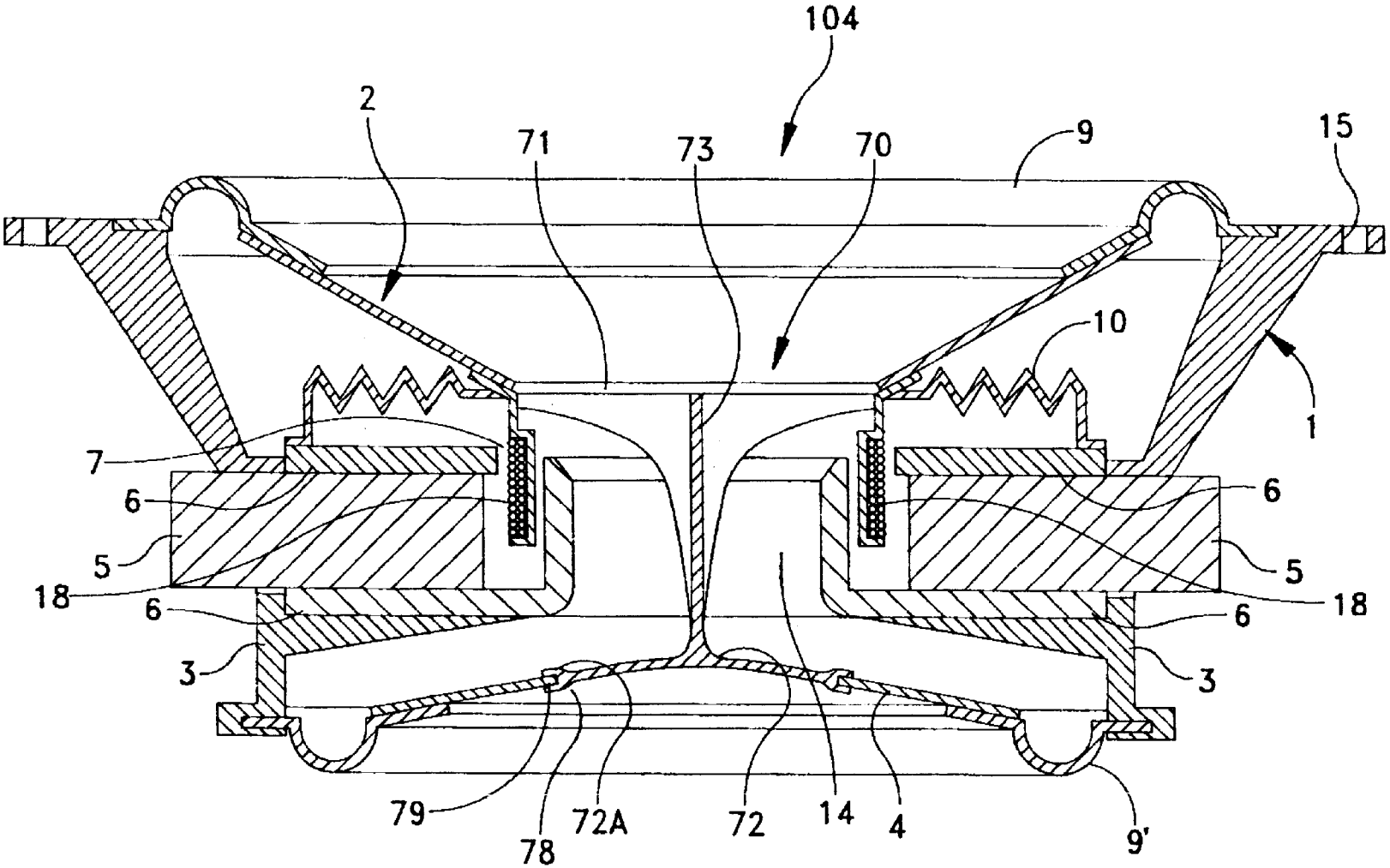
FIG. 7 depicts still yet another embodiment of a dual cone loudspeaker constructed in accordance with this invention.

FIGS. 7 through 10 depict still another loudspeaker embodiment having the same general construction as shown in FIGS. 1 and 4 through 6. Referring specifically to FIG. 7, this loudspeaker embodiment 104 includes a rigid frame 1 that carries a primary speaker cone 2. A subframe 3 carries a secondary speaker cone 4. Both the first and second cones 2 and 4 are annular in shape. A surround 9 connects the primary speaker cone 2 to the frame 1. A surround 9' connects the second annular speaker cone 4 to the subframe 3. A permanent magnet 5 with pole pieces 6 defines an air gap 7 for a voice coil 18. The pole pieces 6 also form a passage or orifice 14 from the chamber formed by the subframe 3 and second speaker cone 4 through the primary speaker cone 2.

In this embodiment the connection between the primary speaker cone 2 and the second cone 4 is constituted by a rigid link 70 that has three basic components. These include a cylindrical section 71, a circular section 72 and a rigid element 73.

Figure 8:
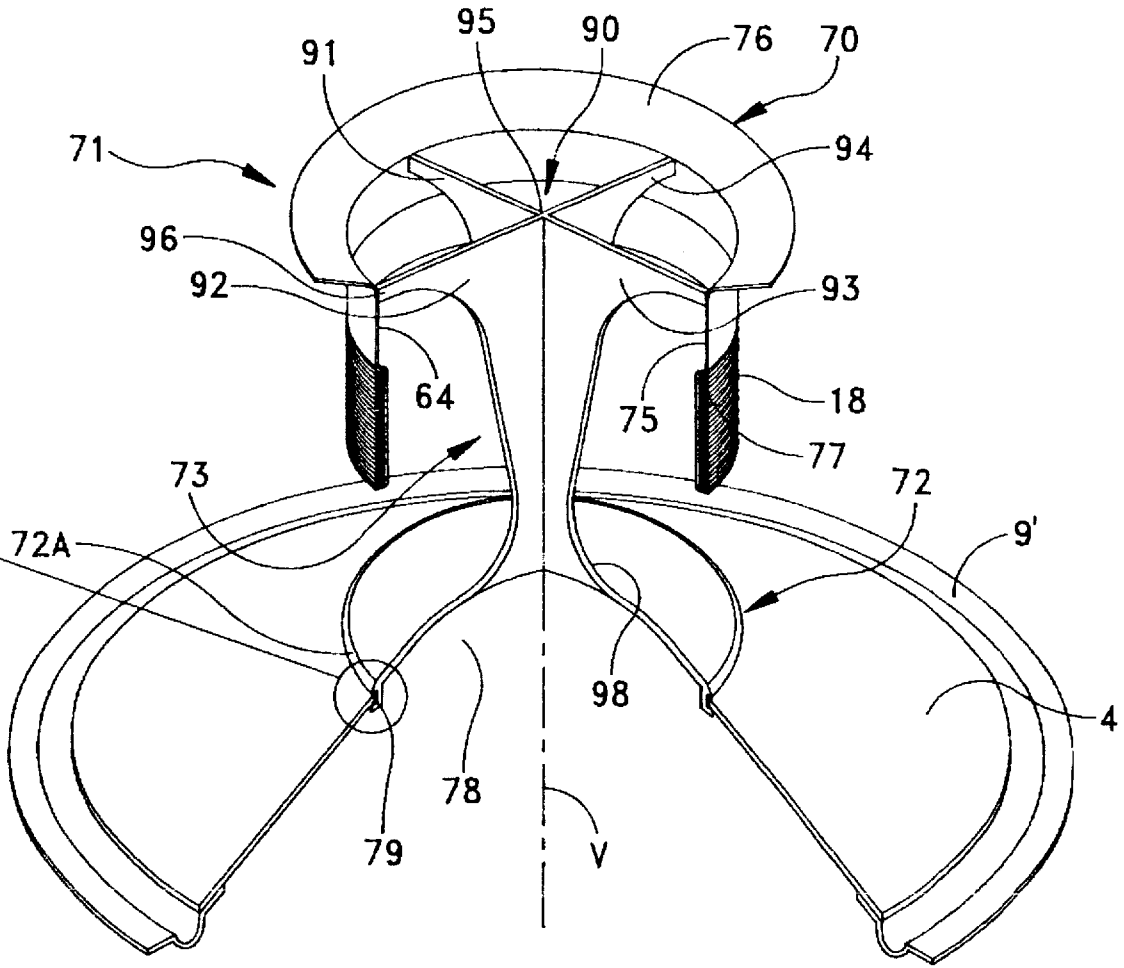
FIGS. 8, 9 and 10 depict certain details of the embodiment of FIG. 7.
Figure 9:
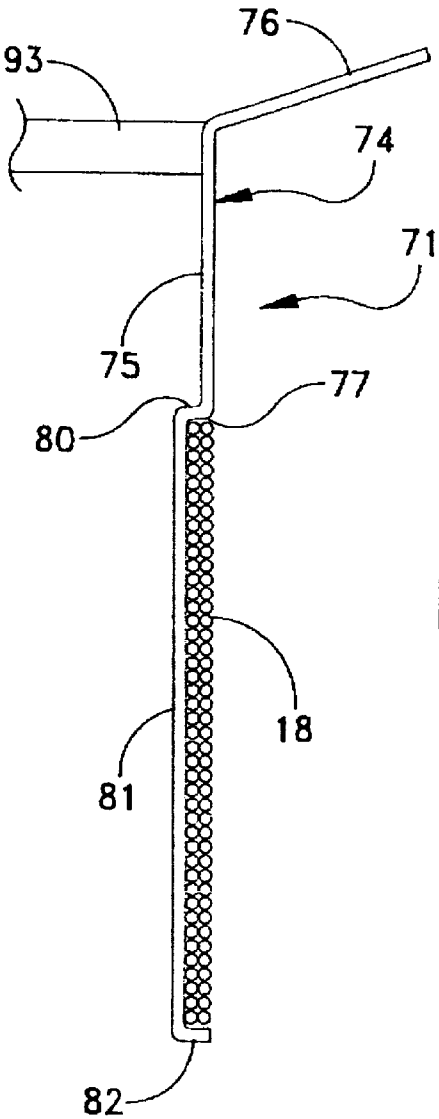

Now referring to FIGS. 7 through 9, the cylindrical section 71 includes a cylinder 74 with a center portion 75. A flared end portion 76 extends from one end of the center portion 75 to provide a surface to which the first speaker cone 2 and the spider 10 can connect in a manner similar to that disclosed with respect to FIG. 5. A channel portion 77 is formed on the other side of the center portion 75. As shown particularly in FIG. 9, a channel is formed by an offset 80, a base portion 81 and a lower lip 82. The resulting channel provides an axially constrained bobbin on which a single or multi-turn voice coil 18 can be wound. An adhesive is applied to the voice coil 18 to adhere it to the base portion 81 according to normal practice. As known, it is possible for this adhesive to fail in use and to allow the coil to unwrap. The channel 77 in the cylindrical structure 71 provides physical containment of the voice coil 18 that should minimize the unraveling even by sliding axially if the adhesive fails.

Now referring to FIGS. 7 and 8, the circular section 72 is rigid to serve as a high-frequency radiator. As previously indicated the second speaker cone 4 has an annular structure that defines a central aperture 78 with a central speaker cone periphery 79. Looking specifically at FIG. 7, the second speaker cone 4 has a predetermined shape in cross-section. The circular section 72 preferably has a corresponding or complementary cross-section with is peripheral edge 72A adjacent and slightly overlapping the central speaker cone periphery 79.

Figure 10:
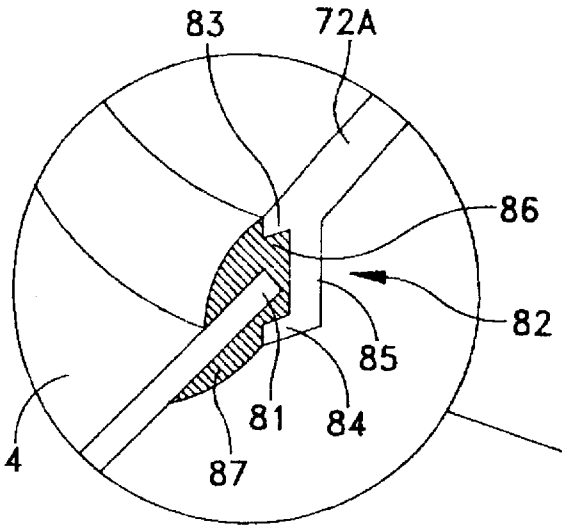

Referring now to the detail of FIG. 10, a peripheral edge 72A comprises bifurcated arms 83 and 84 interconnected by a base 85. This produces a circumferentially extending channel 86 that overlaps and receives the periphery of the second speaker cone 4. An elastomer adhesive 87 fills the channel 86 and encapsulates the periphery of the second speaker cone 4 thereby to provide an elastic bond between the circular section 72 and the second speaker cone 4. Any number of elastomer materials can be provided. Such a material should provide a reliable bond for the environment in which the loudspeaker will be used and should enable the circular section 62 to oscillate at higher audio frequencies with a minimal transfer of that motion to the speaker cone 4 while allowing low frequency excursions of the circular section 62 to be reliably transferred to the speaker cone 4 with minimal attenuation in the magnitude of the excursions.

Referring again to FIG. 8, the rigid element 73 includes an open central structure 90 formed by a plurality of equiangularly spaced, thin planar spokes. In this specific embodiment a plurality of four spokes 91 through 94 extend from a common juncture 95 located on a vertical axis V. Each of the spokes is identical so that the following discussion is limited to spoke 92.

Spoke 92 tapers from a maximum diameter that forms a radial arm 96 between the common juncture 95 and the center portion 75. The spoke 92 tapers to a minimum dimension at a position 97 that is proximate the circular section 72, but spaced slightly therefrom to enable an additional portion of the spoke 92 to provide a transition 98 into the circular section 72. The rigid element 73, by virtue of the intersecting spokes 91 through 94, forms an axially and radially rigid structure. Arms, such as the arm 96 provide stability in the transverse dimension of the cylindrical section 71 so that the voice coil 18 remains in a round configuration. The flared attachment at 98 further provides positional stability between the rigid element 73 and the circular section 72 so that the circular section 72 does not tilt or yaw about the axis V during excursions of the voice coil 18.

The rigid link 70 can be formed as a lightweight, strong integral structure with axial and radial stiffness. This construction minimizes the number of potential adhesive failure points to the attachment points for the primary speaker cone 2, the spider 10 and the second speaker cone 4. At each of these attachment points the rigid link 00 provides a more reliable connection thereby to minimize any failure potential. The result is a loudspeaker that has an improved bass response, an extended upper frequency response and a reliable construction.

Thus in accordance with several objects of this invention, the rigid coupling device 11 shown in FIGS. 1 through 6 with its ring 20 and spokes 22 and the rigid link 70 in FIG. 7 provide rigid, lightweight structures that have an improved ability to attach to primary and secondary speaker cones and thereby increase the overall reliability of a dual cone loudspeaker and facilitate the manufacture of such loudspeakers. Moreover, these improved rigid couplings or rigid links provide a platform for a high frequency radiating structure to enhance the overall operating frequency range and allow the broadcast of a wider range of frequencies with good fidelity.

This invention has been described in terms of certain specific embodiments. It will be apparent to those of ordinary skill in that art that a number of modifications could be made. For example, in one embodiment the improved rigid coupling structure 12 is formed of aluminum. Other metallic and nonmetallic materials such as titanium or plastics could also be utilized. The open support structure 11 is shown with four equiangularly spaced spokes 22 extending out and circumscribed by the ring 20. It will be apparent that any other number of spokes, preferably three or five or more, could be substituted as well as being modified to produce an equivalent structure in an alternate fashion. Finally, this invention has been disclosed in terms of a specific speaker structure with a particular frame and magnet configuration. It will be apparent that the invention is readily adapted to speakers having other frame and magnet configuration. Therefore, it is the intent of the appended claims to cover all such variations and modifications as come within the true spirit and scope of this invention.

What is claimed as new and desired to be secured by Letters Patent of the United States is:

1. A dual cone loudspeaker for directing sound along a speaker axis comprising:

A) a loudspeaker frame with a permanent magnet for defining a magnetic gap,

B) a first annular speaker cone resiliently suspended from the frame,

C) a second speaker cone resiliently suspended from said frame and spaced along the speaker axis from said first speaker cone, D) a voice coil for being energized by an audio signal in electrical form, and E) an open one piece axially rigid structure including:

1) a cylindrical portion located in said magnetic field gap for carrying said voice coil and attached to said first speaker cone whereby low frequency signals applied to said voice coil produce corresponding motion of said first annular speaker cone, 2) an open support structure formed centrally of said cylindrical portion having equiangularly spaced radially extending thin spokes, and 3) a ring circumscribing the ends of said spokes, said structure being connected to said second speaker cone whereby the low frequency motion of said first speaker cone is replicated in said second speaker cone.

2. A dual-cone loudspeaker as recited in claim 1 wherein said loudspeaker additionally includes an annular spider structure intermediate said first speaker cone and said permanent magnet, the outer periphery of said spider structure being attached to said frame and the inner periphery of said spider structure being attached to said cylindrical structure.

3. A dual-cone loudspeaker comprising:

A) a loudspeaker frame with a permanent magnet for defining a magnetic gap,

B) a first speaker cone resiliently suspended from the frame,

C) a second annular speaker cone resiliently suspended from said frame and spaced from said first speaker cone, D) a voice coil for being energized by an audio signal in electrical form, E) a rigid link interconnecting said first and second speaker cones, said rigid link including:

i) a rigid cylindrical structure located in said magnetic field gap that supports said voice coil, ii) a rigid circular structure positioned in the opening through said second annular speaker cone and resiliently attached thereto about the periphery thereof, and iii) a rigid element interconnecting said rigid cylindrical structure and said rigid circular structure whereby low frequency signals applied to said voice coil produce corresponding motion of said first and second speaker cones and high frequency signals applied to said voice coil produce corresponding motion of said rigid circular structure.

4. A dual-cone loudspeaker as recited in claim 3 wherein said second speaker cone has a predetermined cross section and said circular structure has a corresponding cross section.

5. A dual-cone loudspeaker as recited in claim 4 wherein an elastomer effects the attachment between said second speaker cone and said circular structure thereby to enable relative motion of said circular structure at high frequencies relative to said second speaker cone.

6. A dual-cone loudspeaker as recited in claim 5 wherein the periphery of said circular structure adjacent said second speaker cone is bifurcated to form a notch that receives a portion of said second speaker cone adjacent said circular structure and said elastomer.

7. A dual-cone loudspeaker as recited in claim 4 wherein said rigid element includes a plurality of radially extending planar members attached at one end to said cylindrical structure and at the other end to said circular structure.

8. A dual-cone loudspeaker as recited in claim 7 wherein said plurality of planar members is four.

9. A dual-cone loudspeaker as recited in claim 7 wherein the radial dimension of each of said radially extending planar members varies, said maximum radial dimension at the connection to said cylindrical structure.

10. A dual-cone loudspeaker as recited in claim 7 wherein the radial of each of said radially extending planar members varies, said minimum radial dimension being proximate the connection to said circular structure.

11. A dual-cone loudspeaker as recited in claim 7 wherein said cylindrical structure has a flared end portion juxtaposed and attached to said first speaker cone.

12. A dual-cone loudspeaker as recited in claim 11 wherein said speaker additionally includes an annular spider structure intermediate said first speaker cone and said permanent magnet, the outer periphery of said spider structure being attached to said frame and the inner periphery of said spider structure being attached to said flared end portion.

13. A dual-cone loudspeaker as recited in claim 11 wherein said voice coil is wound on said cylindrical structure and said cylindrical structure includes a channel that contains said voice coil.

14. A dual-cone loudspeaker as recited in claim 3 wherein said cylindrical structure has a flared end portion juxtaposed and attached to said first speaker cone.

15. A dual-cone loudspeaker as recited in claim 14 wherein said speaker additionally includes an annular spider structure intermediate said first speaker cone and said permanent magnet, the outer periphery of said spider structure being attached to said frame and the inner periphery of said spider structure being attached to said flared end portion.

16. A dual-cone loudspeaker as recited in claim 15 wherein said voice coil is wound on said cylindrical structure and said cylindrical includes a channel that contains said voice coil.

17. A dual-cone loudspeaker as recited in claim 3 wherein said rigid element includes a plurality of radially extending planar members attached at one end to said cylindrical structure and at the other end to said circular structure.

18. A dual-cone loudspeaker as recited in claim 17 wherein said plurality of planar members is four.

19. A dual-cone loudspeaker as recited in claim 17 wherein the radial dimension of each of said radially extending planar members varies, said maximum radial dimension being at the connection to the cylindrical structure.

20. A dual-cone loudspeaker as recited in claim 17 wherein the radial dimension of each of said radially extending planar members varies, said minimum radial dimension being proximate the connection to said circular structure.

21. A dual-cone loudspeaker for directing sound along a speaker axis comprising:

A) a loudspeaker frame,

B) first and second speaker cones resiliently suspended from the frame and axially spaced along the speaker axis, said first speaker cone having an annular structure, C) a magnet defining an air gap and a moving voice coil positioned in the air gap for displacing said first speaker cone, and D) an axially extending rigid coupling device including:

i) an axially extending structure having one end attached to said second speaker cone, ii) a plurality of equiangularly displaced, thin, radial spokes in planes aligned with the speaker axis extending from said link and terminating at free ends proximate said first speaker cone thereby to form an open structure transverse to the speaker axis whereby air moved by said second speaker cone past said first speaker cone and said axially extending structure and said spokes essentially unimpeded, and iii) a ring attached to said first speaker cone and to the free ends of said spokes, said ring and spokes maintaining said rigid coupling device in a circular configuration at said ring and said axially extending rigid coupling device causing motion of said second speaker cone to replicate the motion of said first speaker cone.

22. A dual-cone loudspeaker as recited in claim 21 additionally including a high frequency radiator for producing high-frequency output signals, said high frequency radiator being attached to said link to be energized in response to high-frequency signals applied to said voice coil and having a narrowest cross-section facing said second speaker cone to provide streamlined air flow past said high frequency radiator.

23. A dual-cone loudspeaker as recited in claim 21 wherein said second speaker cone is formed as an annulus with a central aperture, said loudspeaker additionally including a high frequency radiator with a third speaker cone positioned in the central aperture, a surround for connecting said third speaker cone to said second speaker cone and means including a piezoelectric transducer attached to said open support structure intermediate said hub and said link for driving said third speaker cone independently of signals to said speaker driver.

24. A dual-cone loudspeaker as recited in claim 21 wherein said ring includes a cylindrical portion and an outwardly flared end portion.

25. A dual-cone loudspeaker as recited in claim 21 wherein said ring includes a cylindrical portion for carrying said voice coil.

26. A dual-cone loudspeaker as recited in claim 25 wherein said ring additionally includes a outwardly flared end portion for attachment to said first speaker cone.

27. A dual-cone loudspeaker as recited in claim 21 wherein ring is formed with a cylindrical portion and an outwardly flared end portion.

28. A dual-cone loudspeaker for directing sound along a speaker axis comprising:

A) a loudspeaker frame,

B) first and second speaker cones resiliently suspended from the frame and spaced along the speaker axis, said first speaker cone having an annular diaphragm C) a magnet defining an air gap and a voice coil for displacing said first speaker cone, D) an axially extending rigid link having an open structure spanning the central opening of said first speaker cone and attached to the voice coil interconnecting said first and second speaker cones whereby said link causes the motion of said first speaker cone to be replicated by said second speaker cone, and E) a rigid high-frequency radiator attached to said link that projects high-frequency sound along the speaker axis in response to high-frequency signals applied to said voice coil whereby said dual-cone loudspeaker produces an airstream directed along the speaker axis with low-frequency and high-frequency components.

29. A dual-cone loudspeaker as recited in claim 28 wherein said link includes an open support structure proximate said high frequency radiator.

30. A dual-cone loudspeaker as recited in claim 29 wherein said high frequency radiator has a curved surface having a narrow cross-section facing said second speaker cone that provides a streamlined air flow past said high frequency radiator.

31. A dual-cone loudspeaker as recited in claim 28 additionally including means for attaching said high frequency radiator to said second speaker cone.

32. A dual-cone loudspeaker as recited in claim 31 wherein said second speaker cone is formed as an annulus with a central aperture and said high frequency radiator includes a third rigid speaker cone positioned in the central aperture with a surround for connection to said second speaker cone and means for driving said third speaker cone independently of signals to said voice coil.

33. A dual-cone loudspeaker as recited in claim 32 wherein said means for driving said third speaker cone includes a piezoelectric transducer attached to said link, said transducer driving said third speaker cone at frequencies established by said piezoelectric transducer, said second speaker cone being driven at frequencies applied to said voice coil.

* * * * *